United States Patent [19]

Yamada et al.

[11] Patent Number: 4,672,401

[45] Date of Patent: Jun. 9, 1987

[54] HEAT-SENSITIVE RECORDING MATERIALS

[75] Inventors: Yasuharu Yamada; Tadashi Komoto; Hidehiko Koishi, all of Fukuoka, Japan

[73] Assignee: Nippon Steel Chemical Co., Ltd., Tokyo, Japan

[21] Appl. No.: 745,769

[22] PCT Filed: Oct. 13, 1984

[86] PCT No.: PCT/JP84/00487

§ 371 Date: Jun. 12, 1985

§ 102(e) Date: Jun. 12, 1985

[87] PCT Pub. No.: WO85/01699

PCT Pub. Date: Apr. 25, 1985

[30] Foreign Application Priority Data

Oct. 14, 1983 [JP] Japan ..... 58-191033
Jul. 5, 1984 [JP] Japan ..... 59-137908

[51] Int. Cl.[4] ..... B41M 5/18

[52] U.S. Cl. ..... 503/208; 503/209; 503/225; 427/150

[58] Field of Search ..... 346/208, 209, 225; 427/150, 151, 152

[56] References Cited

U.S. PATENT DOCUMENTS 4,355,070 10/1982 Oeda ..... 346/208

FOREIGN PATENT DOCUMENTS 53-39139 4/1978 Japan ..... 346/209
53-48751 5/1978 Japan ..... 346/209
56-75895 6/1981 Japan ..... 346/209
0027785 2/1982 Japan ..... 346/209
57-89994 6/1982 Japan ..... 346/209
58-153687 9/1983 Japan ..... 346/209

*Primary Examiner*—Bruce H. Hess
*Attorney, Agent, or Firm*—Armstrong, Nikaido, Marmelstein & Kubovcik

[57] ABSTRACT

A heat-sensitive recording material contains, in its heat-sensitive, color-developing layer comprising a leuco dye and an organic acid that reacts with said leuco dye to develop color upon heating, a hydrocarbon compound melting at a temperature in the range from 50° C. to 200° C. and selected from benzylbiphenyls, alkyl-substituted benzylbiphenyls, hydrogenated benzylbiphenyls, hydrogenated alkyl-substituted benzylbiphenyls, hydrogenated terphenyls and hydrogenated alkyl-substituted terphenyls. With its quick thermal response, this material is suitable for high-speed recording.

6 Claims, 1 Drawing Figure

HEAT-SENSITIVE RECORDING MATERIALS

TECHNICAL FIELD

This invention relates to heat-sensitive recording materials extensively used in computer output, printers for desk calculators and the like, recorders for various measuring instruments, facsimiles, automatic ticket vendors and heat-sensitive copying machines. More particularly it relates to heat-sensitvie recording materials with quick thermal response suitable for high-speed recording.

BACKGROUND ART

With the spectacular diversification and expanding volume of information in recent years, various new recording processes and materials have been developed and put to practical use. Of these, the heat-sensitive recording process has many advantages: (1) desired prints can be obtained simply by heating heat-sensitive materials, with no need for cumbersome development process; (2) heat-sensitive recording materials can be manufactured and stored more easily and at less costs than any other type of recording material; and (3) when paper, which is an inexpensive material, is used as the substrate, as is often the case, the resulting heat-sensitive recording materials have a favorable feel like plain paper.

Heat-sensitive recording materials commonly used for this purpose are composed of a suitable substrate, such as paper, synthetic paper and synthetic resin film, and a heat-sensitive, color-developing layer coated thereupon which contains a colorless or faint-color leuco dye and an organic acid that is capable of reacting with said leuco dye to develop color upon heating.

More recently there has been a great demand in this field for improved heat-sensitive recording materials adapted for high-speed recording which will give prints of sufficient density with shorter heating time of, and lower voltage applied to, thermal heads.

In order to meet this requirement, Japanese patent application Laid-open No. 39,139 (1978) teaches a heat-sensitive recording material containing, in its color-developing layer, at least one compound melting at a temperature in the range from 60° C. to 200° C. and selected from alkylbiphenols and substituted biphenylalkanes. Japanese patent application Laid-open No. 48,751 (1978) also proposes a heat-sensitive recording material containing a fusible substance which melts at a temperature in the range from 60° C. to 200° C.

These prior arts, however, are still unsatisfactory in terms of thermal response and print quality in high-speed recording.

The primary object of this invention is to provide a heat-sensitive recording material which shows quick thermal response and hence is capable of giving sharp and clear prints of high density even in high-speed recording. A further object of this invention is to provide a heat-sensitive recording material which contains, in its color-developing layer comprising a leuco dye and an organic acid capable of reacting with said leuco dye to develop color upon heating, a specific hydrocarbon compound that can act as a color development accelerator. A still further object of this invention is to provide a heat-sensitive recording material having a heat-sensitive, color-developing layer which contains a leuco dye and an organic acid that reacts, upon heating, with said leuco dye to develop color, said heat-sensitive, color-developing layer also containing at least one hydrocarbon compound melting at a temperature in the range from 50° C. to 200° C. and selected from the group consisting of benzylbiphenyls, alkyl-substituted benzylbiphenyls, hydrogenated benzylbiphenyls, hydrogenated alkyl-substituted benzylbiphenyls, hydrogenated terphenyls and hydrogenated alkyl-substituted terphenyls.

DISCLOSURE OF INVENTION

This invention relates to heat-sensitive recording materials having a heat-sensitive, color-developing layer which contains a colorless or faint-color leuco dye and an organic acid that reacts, upon heating, with said leuco dye to develop color, said heat-sensitive, color-developing layer also containing at least one hydrocarbon compound melting at a temperature in the range from 50° C. to 200° C. and selected from the group consisting of benzylbiphenyls, alkyl-substituted benzylbiphenyls, hydrogenated benzylbiphenyls, hydrogenated alkyl-substituted benzylbiphenyls, hydrogenated terphenyls and hydrogenated alkyl-substituted terphenyls.

The leuco dyes used in this invention as color developer are compounds which are colorless or faint in color at normal temperature and react with an acidic substance to develop color upon heating. Typical examples include triarylmethane dyes, such as 3,3-bis (p-dimethylaminophenyl)-6-dimethylaminophthalide; diphenylmethane dyes, such as 4,4-bis-dimethylaminobenzhydryl benzyl ether; fluoran dyes, such as 7-diethylamino-3-chlorofluoran; thiazine dyes, such as benzoyl-leuco-Methylene-Blue; spiro dyes, such as 3-methyl-spiro-dinaphthopyran; and leuco bases of auramine, indoline and indigo dyes.

The organic acids used in combination with the above-mentioned leuco dyes are compounds which react, upon heating, with said leuco dyes to develop color. Typical examples include phenols and various types of organic acids, and those which are solid at room temperature and melt or vaporize when heated to 50° C. or higher are preferably employed. As illustrated examples may be mentioned among others phthalic anhydride, gallic acid, salicylic acid, 4,4'-isopropylidenediphenol, 4,4'-isopropylidene-bis (2-chlorophenol), 4,4'-isopropylidene-bis(2-t-butylphenol), 4,4'-sec-butylidenediphenol, 4,4'-(1-methyl-n-hexylidene)-diphenol, 4-phenylphenol, 4-hydroxydiphenoxide, methyl-4-hydroxybenzoate, phenyl-4-hydroxybenzoate, 4-hydroxyacetophenone, salicylanilide, 4,4'-cyclohexylidenediphenol, 4,4'-cyclohexylidene-bis(2-methylphenol), 4,4'-benzylidenediphenol, 4,4'-thio-bis(6-t-butyl-3-methylphenol), novolak type phenol resin and haolgenated derivative thereof, $\alpha$-naphthol and $\beta$-naphthol.

The hydrocarbon compounds used in this invention, which melt at a temperature in the range from 50° C. to 200° C. and are selected from the group consisting of benzylbiphenyls, alkyl-substituted benzylbiphenyls, hydrogenated benzyl-biphenyls, hydrogenated alkyl-substituted benzylbiphenyls, hydrogenated terphenyls and hydrogenated alkyl-substituted terphenyls, serve as a promotor for the color-developing reaction. These have lower melting or sublimation point than the leuco dye and/or the organic acid, and are also capable of dissolving the dye and/or acid when heated, thus accelerating the reaction between the two. The alkyl substituents in the alkyl-substituted derivatives of benzylbiphenyls, hydrogenated benzylbiphenyls and hydrogenated terphenyls should preferably be alkyls of 1 to 4 carbon atoms, more preferably methyl or ethyl.

Illustrated examples of these hydrocarbon compounds include o-benzylbiphenyl (mp:56° C.), p-benzylbiphenyl (mp:86° C.), p-cyclohexylmethylbiphenyl (mp:58° C.), o-cyclohexylmethyldicyclohexyl (perhydro-o-benzylbiphenyl) (mp:62° C.), m-cyclohexylmethyldicyclohexyl (mp:65° C.), alkyl derivatives thereof, 1,3-dicyclohexylcyclohexane (octadecahydro-m-terphenyl), 1,4-dicyclohexylcyclohexane (octadecahydro-p-terphenyl), 1,4-dicyclohexylcyclohexane, 4-cyclohexyl-1-phenylcyclohexane, 1,4-dicyclohexen-1-ylbenzene, 1-cyclohexyl-4-(p-tolyl)cyclohexane, 1,3-dicyclohexyl-5-methylbenzene, 1,4dicyclohexyl-2,5-dimethylbenzene, 1,5-dicyclohexyl-2,4-dimethylbenzene, 1,4-dicyclohexyl-2,6-dimethylbenzene, 1,5-dicyclohexyl-2, 3-dimethylbenzene and 1,4-bis(1-methylcyclohexyl)benzene. These hydrocarbon compounds may be used alone or in combination.

The suitable amount of these color-developing accelerator may be different depending on the leuco dye and organic acid used in combination, but normally is in the range from 0.5 to 30 parts by weight, per one part of the leuco dye, more preferably in the range from 1 to 10 parts. Any known color-developing accelerator may also be employed in combination.

The heat-sensitive recording materials of this invention may also contain various types of additives depending on specific uses. These include binders which serve to separately immobilize the finely dispersed particles of leuco dye and organic acid, such as polyvinyl alcohol (PVA), methylcellulose, hydroxyethylcellulose, polyacrylic acid, casein, gelatin, starch and derivatives thereof; and metal soaps and white pigment, such as calcium carbonate, kaolin, clay, talk and titanium oxide, to improve the whiteness of final products, to give moderate surface roughness for ease of subsequent noting, and to prevent sticking.

These components are coated on a substrate, such as paper and film, in one or separate layers, forming a heat-sensitive, color-developing layer.

PREFERRED EMBODIMENTS OF THE INVENTION

Figure 1:
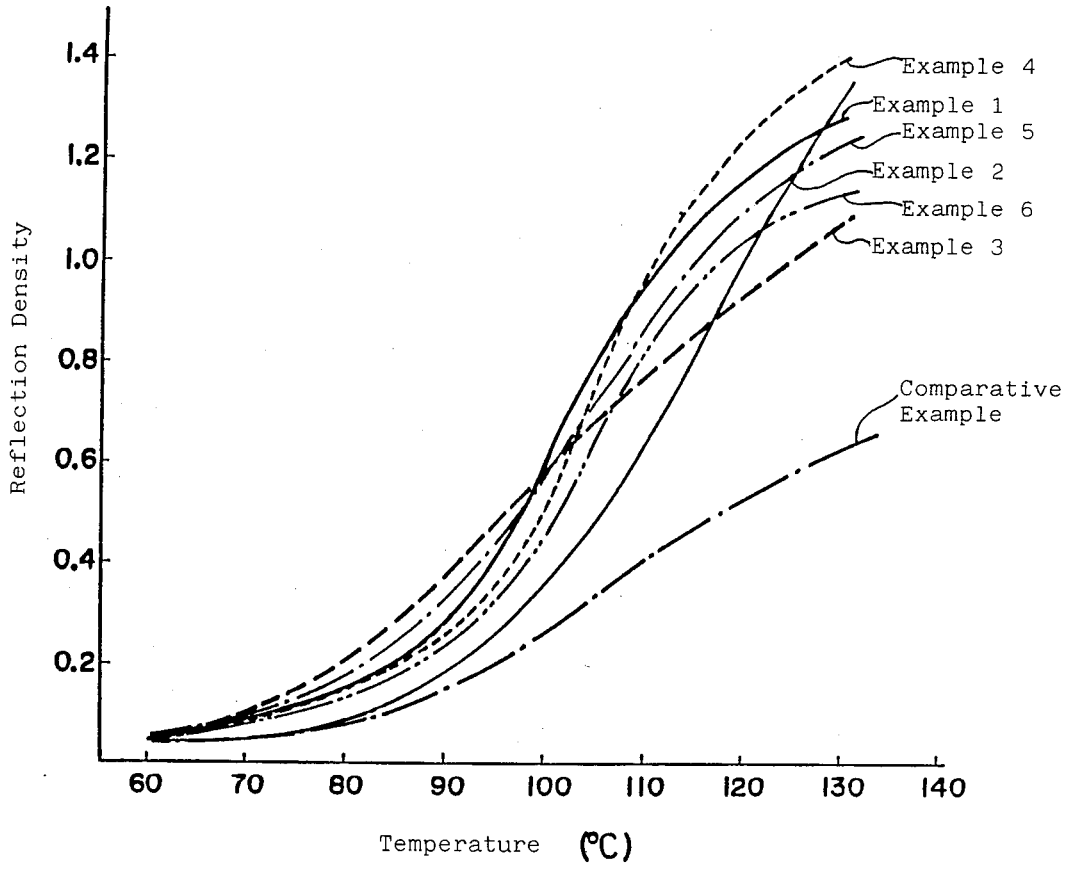
FIG. 1 shows graphs illustrating the temperature versus reflection density relationship of the heat-sensitive recording materials described in Examples 1 through 6 and Comparative Example.

The following Examples and Comparative Example further illustrate this invention.

EXAMPLE 1

(1) Preparation of Liquor A

Crystal Violet lactone (15 parts by weight), p-benzylbiphenyl (50 parts) and 10% aqueous solution of PVA (500 parts) were intimately mixed in a ball mill for five hours, giving Liquor A.

(2) Preparation of Liquor B

Bisphenol A (75 parts by weight) and 15% aqueous solution of PVA were intimately mixed in a ball mill for five hours, giving Liquor B.

(3) Preparation of Heat-sensitive Recording Paper

Liquor A (100 parts by weight) and Liquor B (100 parts) were mixed, and the solution thus obtained was coated on paper (50 g/m$^2$) and dried, giving heat-sensitive recording paper with a dry add-on of 5 g/m$^2$.

EXAMPLES 2 THROUGH 6

Heat-sensitive recording paper was prepared in a similar manner to Example 1 using, in place of p-benzylbiphenyl, o-benzylbiphenyl (Example 2), o-cyclohexylmethyldicyclohexyl (Example 3), p-dicyclohexylbenzene (Example 4), 1,3-dicyclohexylcyclohexane (Example 5) and 1,4-dicyclohexyl-2, 5-dimethylbenzene (Example 6).

COMPARATIVE EXAMPLE

Liquor A was prepared from Crystal Violet lactone (15 parts by weight) and 10% aqueous solution of PVA (250 parts). Liquor B was prepared from bisphenol A (75 parts by weight) and 15% aqueous solution of PVA (500 parts). Liquor A (100 parts by weight) was mixed with Liquor B (200 parts), and the solution thus obtained was coated on paper in the same way as above, giving heat-sensitive recording paper with a dry add-on of 5 g/m$^2$.

Each of the heat-sensitive recording paper prepared in Examples 1 through 6 and in Comparative Example was tested on a stamp color-developing tester at different temperatures between 60° C. and 130° C., and the color density was measured by a reflection densitometer (Sakura Digital Reflection Densitometer, Model PDA-45). The result is summarized in FIG. 1.

As can be seen from this figure, the heat-sensitive recording paper prepared in Examples 1 through 6 show quicker thermal response (sharper rise in reflection density with increase in temperature), compared with that obtained in Comparative Example.

INDUSTRIAL UTILITY

As is apparent from the foregoing, the heat-sensitive recording materials of this invention contain, in their heat-sensitive, color-developing layer, at least one specific compound (hydrocarbons melting at a temperature in the range from 50° C. to 200° C. and selected from the group consisting of benzylbiphenyls, alkyl-substituted benzylbiphenyls, hydrogenated benzylbiphenyls, hydrogenated alkyl-substituted benzylbiphenyls, hydrogenated terphenyls and hydrogenated alkyl-substituted terphenyls), and hence have better thermal response (sharper rise, in reflection density with the increase in temperature). This makes them capable of giving clear and sharp prints when used in computer output, printers for desk calculators and the like, recorders for various measuring instruments, facsimiles, automatic ticket vendors, heat-sensitive copying machines and other latest equipment which are operated at increasingly higher speeds.

What is claimed is:

1. A heat-sensitive recording material having a heat-sensitive, color-developing layer which contains a leuco dye and an organic acid that reacts, upon heating, with said leuco dye to develop color, said heat-sensitive, color-developing layer also containing at least one hydrocarbon compound melting at a temperature in the range from 50° C. to 220° C. said hydrocarbon compound being a benzylbiphenyl.

2. The heat-sensitive recording materials as defined in claim 1, wherein said hydrocarbon compound is p-benzyl-biphenyl.

3. The heat-sensitive recording materials as defined in claim 1, wherein said hydrocarbon compound has an alkyl substituent group (or groups) of 1 to 4 carbon atoms.

4. The heat-sensitive recording material as defined in claim 1, wherein said hydrocarbon compound has methyl or ethyl substituent group (or groups).

5. The heat-sensitive recording material as defined in claim 1, wherein said hydrocarbon compound is a partially hydrogenated hydrocarbon.

6. The heat-sensitive recording materials as defined in claim 1, wherein said hydrocarbon compound is a perhydro-hydrocarbon.

* * * * *